US006656890B1

(12) United States Patent
Fish et al.

(10) Patent No.: US 6,656,890 B1
(45) Date of Patent: Dec. 2, 2003

(54) GREASE COMPOSITION FOR CONSTANT VELOCITY JOINTS

(75) Inventors: Gareth Fish, West Midlands (GB); Jennifer Sarah Cooper, West Midlands (GB); Jisheng E, West Midlands (GB); Trevor David Davies, West Midlands (GB); Gareth Robert Isaac, West Midlands (GB)

(73) Assignee: GKN Automotive GmbH (DE)

( * ) Notice: Subject to any disclaimer, the term of this patent is extended or adjusted under 35 U.S.C. 154(b) by 0 days.

(21) Appl. No.: 09/913,566

(22) PCT Filed: Feb. 8, 2000

(86) PCT No.: PCT/GB00/00360

§ 371 (c)(1),
(2), (4) Date: Jan. 16, 2002

(87) PCT Pub. No.: WO00/49112

PCT Pub. Date: Aug. 24, 2000

(30) Foreign Application Priority Data

Feb. 16, 1999 (GB) ..... 9903380

(51) Int. Cl.[7] ..... C10M 169/00; C10M 111/04; C10M 137/10

(52) U.S. Cl. ..... 508/570; 508/577; 508/579

(58) Field of Search ..... 508/370, 377, 508/379

(56) References Cited

U.S. PATENT DOCUMENTS 4,879,054 A * 11/1989 Waynick ..... 508/174
5,516,439 A * 5/1996 Takeuchi et al. ..... 508/374
5,585,336 A * 12/1996 Ozaki et al. ..... 508/365
5,672,571 A * 9/1997 Hatakeyama et al. ..... 508/321
6,258,760 B1 * 7/2001 Ozaki et al. ..... 508/365
6,403,538 B1 * 6/2002 Ozaki et al. ..... 508/367

FOREIGN PATENT DOCUMENTS

| | | | |
|---|---|---|---|
| EP | 0761804 | * | 3/1997 |
| FR | 2765886 | * | 7/1995 |
| GB | 2287715 | * | 9/1995 |
| GB | 2346892 | * | 8/2000 |
| WO | Wo 99/02629 | * | 1/1999 |

* cited by examiner

*Primary Examiner*—Jacqueline V. Howard

(57) ABSTRACT

A lubricating grease composed of a base oil combination comprising 10 to 35% of one or more poly α-olefins, 3 to 15% of one or more synthetic organic esters, 20 to 30% of one or more naphthenic oils, the remainder of the combination being one or more paraffinic oils, the percentages being by weight of the total base oil combination and the ratio of the weight of the ester(s) in the combination to the weight of the poly α-olefin(s) therein being not greater than 1:3; between 2 and 15 % by weight of the total grease of a lithium soap thickener, between 1 and 5% by weight of the total grease of a molybdenum dithiophospbate; between 1 and 5% by weight of the total grease of a zinc dialkyldithiophosphate; between 1 and 5% by weight of the total grease of a sulphur-free friction modifier, and some or all of the normal grease additives such as anti-oxidants, corrosion inhibitors, extreme pressure additives and tackiness agents.

17 Claims, 1 Drawing Sheet

GREASE COMPOSITION FOR CONSTANT VELOCITY JOINTS

Figure 1:
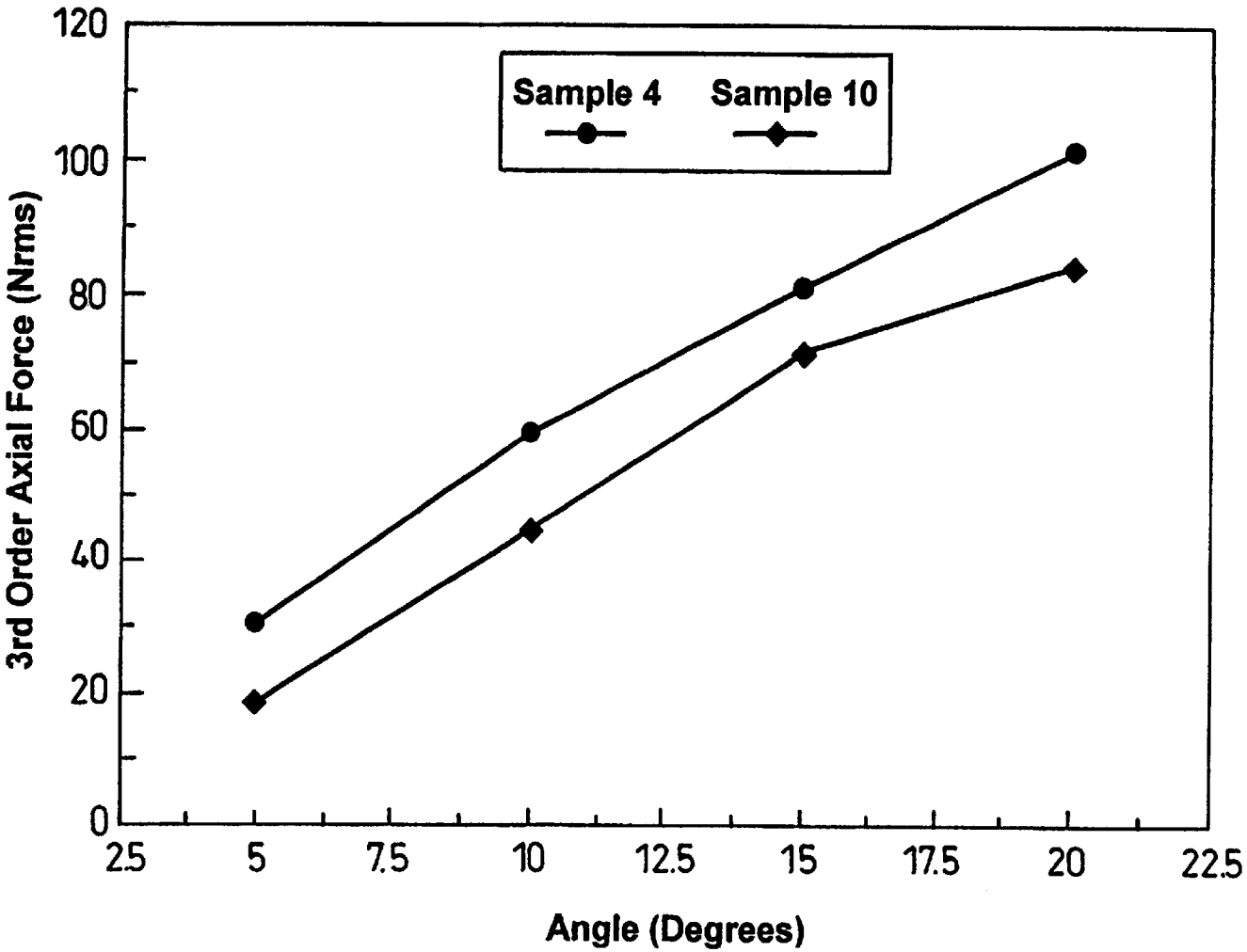

This application is a 371 of PCT/6B00/00360

TECHNICAL FIELD

This invention relates to a lubricating grease which is intended primarily for use in constant velocity universal joints which are used in the drivelines of motor vehicles.

BACKGROUND ART

The motions of components within constant velocity joints (CVJ) are complex with a combination of rolling, sliding and spinning. When the joints are under torque, the components are loaded together which can not only cause wear on the contact surfaces of the components, but also rolling contact fatigue and significant frictional forces between the surfaces. The wear can result in failure of the joints and the frictional forces can give rise to noise, vibration and harshness (NVH) in the driveline. NVH is normally "measured" by determining the axial forces generated in plunging type CVJ. Ideally the greases used in constant velocity joints need not only to reduce wear, but also have to have a low coefficient of friction to reduce the frictional forces and to reduce or prevent NVH.

Constant velocity joints also have sealing boots of elastomeric material which are usually of bellows shape, one end being connected to the outer part of the CVJ and the other end to the interconnecting or output shaft of the CVJ. The boot retains the grease in the joint and keeps out dirt and water.

Not only must the grease reduce wear and friction and prevent the premature initiation of rolling contact fatigue in a CVJ, it must also be compatible with the elastomeric material of which the boot is made otherwise there is a degradation of the boot material which causes premature failure of the boot, allowing the escape of the grease and ultimately failure of the CVJ. The two main types of material used for CVJ boots are polychloroprene rubber (CR) and ether-ester block co-polymer thermoplastic elastomer (TEEE).

Typical CVJ greases have base oils which are blends qf naphthenic (saturated rings) and paraffinic (straight and branched saturated chains) mineral oils. Synthetic oils may also be added. It is known that these base oils have a large influence on the deterioration (swelling or shrinking) of CR boots. All mineral and synthetic base oils extract the plasticisers and other protective agents from the rubber boot materials. Paraffinic mineral oils and poly α-olefin (PAO) synthetic base oils diffuse very little into the CR causing shrinkage, but on the other hand naphthenic mineral oils and synthetic esters diffuse into the CR and act as plasticisers and can cause swelling. The plasticisers used in the CR used for boots typically have pour points below −50° C. and this gives the CR good low temperature properties. The naphthenic mineral oils used in CVJ greases have a pour point which is typically around −35° C., although this can depend on the viscosity and refining process of the naphthenic oils. The exchange of the rubber plasticiser(s) for the naphthenic mineral oil can therefore significantly reduce the rubber performance at low temperatures and may cause the rubber boots to fail by cold cracking, ultimately resulting in failure of the CVJ. If significant swelling or softening occurs, the maximum high speed capability of the boot is reduced due to poor stability at speed and/or excessive radial expansion.

The addition of a plasticiser to grease base oil is effective in retaining the cold temperature performance of the CR after ageing by reducing the loss of plasticiser from the CR but has the following deleterious effects:

1. it increases the volume change of the CR after ageing; and
2. it reduces the base oil viscosity and hence increases friction and wear and may promote rolling contact fatigue in the CVJ.

The object of the invention is to provide a lubricating grease, primarily for CVJ, which has a good compatibility with CR boot materials and which also gives low wear and low friction and prevents the premature initiation of rolling contact fatigue in the joint.

DISCLOSURE OF THE INVENTION

According to the invention we provide a lubricating grease composed of:

a. a base oil combination comprising 10 to 35% of one or more poly α-olefins, 3 to 15% of one or more synthetic organic esters, 20 to 30% of one or more naphthenic oils, the remainder of the combination being one or more paraffinic oils, the percentages being by weight of the total base oil combination and the ratio of the weight of the ester(s) in the combination to the weight of the poly α-olefin(s) therein being no greater than 1:3 (preferably approximately 1:4)

b. between 2 and 15% by weight of the total grease of a lithium soap thickener;

c. between 1 and 5% (preferably between 1 and 2%) by weight of the total grease of a molybdenum dithiophosphate of the following general formula:

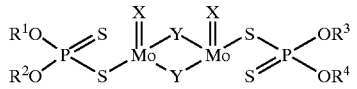

wherein X or Y represents S or O and each of $R^1$ to $R^4$ inclusive may be the same or different and each represents a primary (straight chain) or secondary (branched chain) alkyl group having between 1 and 24 carbon atoms or an aryl group having between 6 and 30 carbon atoms;

d. between 1 and 5% (preferably between 1 and 2%) by weight of the total grease of a zinc dialkyldithiophosphate of the following general formula:

$$(R^5O)(R^6O)SP—S—Zn—S—PS(OR^7)(OR^8)$$

wherein each of $R^5$ to $R^8$ inclusive may be the same or different and each represents a primary or secondary alkyl group having 1 to 24, preferably 3 to 8 carbon atoms;

e. between 1 and 5% (preferably between 1 and 2%) by weight of the total grease of a sulphur-free friction modifier; and f. some or all of the normal grease additives such as anti-oxidants, corrosion inhibitors, extreme pressure additives, and tackiness agents.

We have found that the use of the above mentioned base oil combination together with the inclusion of the molybdenum dithiophosphate (MoDTP), the zinc dialkyldithiophosphate (ZDTP) and the sulphur-free friction modifier gives a grease which has significantly less deleterious effect on the CR material of the boots, and which gives both very good wear and friction properties, prevents the initiation of rolling contact fatigue and reduces the axial forces in plunging type CVJ.

The preferred organic synthetic esters are di-carboxylic acid derivatives with sub-groups based on aliphatic alcohols.

Preferably the di-carboxylic acid is sebacic acid and the alcohols have primary, straight or branched carbon chains with 2 to 20 carbon atoms. The preferred synthetic ester is therefore dioctyl sebacate (DOS) but dioctyl adipate (DOA), dioctyl phthalate (DOP), or dioctyl azelate (DOZ), which are also used as plasticisers in the CR boot materials, may also be used.

Preferably the sulphur-free friction modifier is an organo-molybdenum complex, preferably a complex of an organo-amide as described for example in U.S. Pat. No. 4,889,647 the disclosure of which is imported herein by reference.

The molybdenum dithiophosphate may be sulphurised oxymolybdenum-2-ethylhexyl phosphorodithioate and the zinc dialkyldithiophosphate may be a mixture of primary and secondary alkyl dithiophosphates with carbon chains of between 3 and 14 atoms.

The thickener may be a simple lithium soap formed from stearic acid, 12-hydroxy stearic acid or from other similar fatty acids or mixtures thereof or methyl esters of such acids. Alternatively a lithium complex soap may be used formed e.g. from a mixture of long chain fatty acids together with a complexing agent, e.g. a borate or one or more dicarboxylic acids. The use of complex lithium soaps allows the grease to operate up to a temperature of about 180° C. whereas with simple lithium soaps the grease will only operate up to a temperature of about 120° C.

The grease may include between 0.5 to 3.0% by weight of a calcium sulphonate salt as a corrosion inhibitor. Typically, the last operation before assembly of a CVJ is a wash to remove machining debris, it is therefore necessary for the grease to absorb any traces of remaining water and to prevent that water from causing corrosion and adversely affecting the performance of the CVJ.

The grease may also include between 0.10 to 3.0% by weight of a metal-free but sulphur-phosphorus containing extreme pressure additive which has a sulphur content ranging from 15 to 35% by weight and a phosphorus content ranging from 0.5 to 3.0% by weight and which exhibits excellent effects of inhibiting wear and of preventing seizure of CVJs. If the phosphorus content exceeds the upper limit defined above, a deleterious effect on the boot material may occur. If the sulphur content exceeds the upper limit defined above, it may promote the initiation of rolling contact fatigue of the contacting metal components.

The grease may include between 0.1 to 2.0% by weight of an anti-oxidant to inhibit the oxidation degradation of the base oils and to lengthen the life of the grease and as a result prolong the life of the CVJ. The anti-oxidant may be an amine, preferably an aromatic amine which may be phenyl alpha-naphthylamine or di-phenylamine or derivatives thereof.

BEST MODE FOR CARRYING OUT THE INVENTION

In order to determine the effect of different oils on the deterioration of rubber materials, test pieces of a standard polychloroprene rubber for CVJs were fully immersed in different grease base oil components for 70 hours at 120° C. The changes in hardness (ΔH (Shore A) and volume (ΔV %) of the rubber test pieces after ageing by immersion were determined and are shown in Table 1. The larger the change in the rubber properties, the greater the deterioration of the CR.

TABLE 1

| Sample | Oil Composition, percentages by weight | Change in Property after immersion for 70 hours at 120° C. ΔV (%) | ΔH (Shore A) |
|---|---|---|---|
| A | Naphthenic oil | +28.1 | −16 |
| B | Naphthenic oil/DOS (90:10) | +36.26 | −19 |
| C | Paraffinic oil | −3.5 | +2 |
| D | Paraffinic oil/DOS (90:10) | +4.39 | −4 |
| E | PAO 8 | −17.0 | +19 |
| F | PAO 8/DOS (90:10) | −11.73 | +14 |
| G | Synthetic Ester | +8.15 | −6 |
| H | Paraffinic/Naphthenic (70:30) | +7.3 | −5 |
| I | Paraffinic/Naphthenic/DOS (70:25:5) | +2.09 | −1 |
| J | Paraffinic/Naphthenic/PAO (55:25:20) | −5.08 | +5 |
| K | Paraffinic/Naphthenic/PAO/DOS (50:25:20:5) | −2.31 | +4 |

The Oils

The PAO was a Ziegler catalysed n-dec-l-ene and had a viscosity of 8 centistokes at 100° C.

The naphthenic oil was a solvent refined straight-cut oil with a viscosity of 130 centistokes at 40° C.

The paraffinic oil in Examples C, D and H was a solvent neutral oil having a viscosity of 500 SUS at 100° F. The paraffinic oil in Examples I, J and K was a hydro-treated solvent-extracted oil having a viscosity of 650 SUS at 100° F.

The DOS was a mixture of C8 sebacic acid derivatives with a viscosity of ~2 centistokes at 100° C.

The synthetic ester was a high viscosity polymer ester with a viscosity of 115 centistokes at 400° C.

The compatibility of the grease base oil with the CR depends on the type and refining process of the oil. Table 1 shows that naphthenic oil (Sample A) causes the CR to have a large increase in volume and a large reduction in hardness. Chemical analysis showed that the naphthenic oil was absorbed into the rubber and despite the loss of plasticiser resulted in the large increase in volume of the CR and corresponding large reduction in the hardness. The addition of 10% DOS made the results worse (Sample B).

The paraffinic oil (Sample C) had little effect on the hardness of the CR and the volume change since the plasticiser loss was offset by the uptake of the oil although this depends on the viscosity of the oil and its refining process. The addition of 10% DOS (Sample D) resulted in an increase in volume decrease in hardness as with as was seen for naphthenic oil but on balance did not significantly affect CR compatibility.

The PAO (Sample E) had an opposite effect to that of naphthenic oil in that it caused an increase in the hardness of the CR and a large reduction in volume. Chemical analysis showed that the PAO extracted the plasticisers and other protective agents from the CR without itself being absorbed in the CR and resulted in the deterioration of the rubber. The addition of 10% DOS (Sample F) improved the results to some extent.

Synthetic esters are known to cause swelling and loss of hardness of the CR (Sample G) and have a similar effect on CR as naphthenic oils, i.e. increase in volume and decrease in hardness.

Sample H shows that an excessive amount of naphthenic oil in the mixture (i.e. 30% or more) can cause too much swelling.

Samples I to K show the effects of various mixtures of oil as specified in Tables 2 and 3 below. It will be seen that the net volume and hardness change can be minimised by blending different base oils with a plasticiser, the best results being shown by Sample I which is a mixture of paraffinic and naphthenic oils with DOS. However we have found that it is necessary to include PAO in the base oil to combat the effects of the MODTP in the fully formulated grease and which causes swelling and softening of the CR. Thus in practice the best usable result is the oil combination of Sample K which includes naphthenic oil, paraffinic oil, PAO and di-ctyl sebacate.

For a fully formulated grease, diffusion rates of the oils into the CR controls the compatibility of the grease to the CR as measured by the changes in volume and hardness. However the chemical effects of the additives need to be determined by measuring the changes in the mechanical properties i.e. tensile strength and elongation after ageing.

EXAMPLES

In order to illustrate the invention various grease samples were made up with the constituents shown in Tables 2 and 3. The percentages of the constituents are by weight of the total grease except that the constituents of the base oil combination are shown in brackets as the percentage by weight of the total of that combination. The oils were those described above, the paraffinic oil being that used in Examples I, J and K.

List of Other Constituents

| Additive type | Commercial name | Manufacturer |
|---|---|---|
| Sulphur-free friction modifier | Molyvan 855 | R.T. Vanderbilt |
| MoDTP | RC 3580/ Molyvan L | Rhein Chemie/R.T. Vanderbilt |
| MoDTC | Molyvan 822 | R.T. Vanderbilt |
| Primary/secondary ZDTP | RC 3038/LZ 1360 | Rhein Chemie/Lubrizol |
| Secondary ZDTP | RC 3180/LZ1375 | Rhein Chemie/Lubrizol |
| Corrosion inhibitor 1 | NaSul 729 | King Industries |
| Corrosion inhibitor 2 | Alox 165 | Alox corporation |
| EP additive | Mobilad G305 | Mobil |
| Boron-containing additive | Oloa 9750 | Oronite Chemical |
| Anti-oxidant | RC 7130 | Rhein Chemie |

Molyvan 855: Organo molybdenum complex of organic amide;
RC 3580: 2-Ethylhexyl molybdenum dithiophosphate in mineral oil
Molyvan L: molybdenum dithiophosphate
Molyvan 822: organo molybdenum dithiocarbamate
RC 3038: } zinc dialkyldithiophosphate with primary and secondary alkyl groups in
LZ 1360: } mineral oil;
RC 3180: 2-ethylhexyl zinc dithiophosphate
LZ 1375: zinc dialkyldithiophosphate secondary alkyl groups with 1 to 14 carbon atoms
NaSul 729: 50% calcium dinonylnaphthalene sulfonate in light mineral oil;
Alox 165: mixed calcium petroleum sulphonate
Mobilad G305: 20–30% alkyl phosphoric acid ester amine salt (amine phosphate) and 55–65 sulfurized isobutylene (sulphurised oil);
RC 7130: N-Phenyl-alpha-naphthylamine (PAN)(>98%)
Oloa 9750 Boron-containing additive Some of the grease samples were evaluated against the standard CR before and after single sided ageing for 70 hours at 120° C. Changes in hardness on the air side and on the grease side were measured as well as the glass transition temperature. The greater the change in the hardness, the higher a level of deterioration of the CR and the worse the compatibility at high temperatures. The lower the glass transition temperature the better the low temperature performance of the rubber. In order for the boot to have satisfactory low temperature durability after ageing, it is necessary that the glass transition temperature of the CR remains as low as possible. Some of the grease samples were evaluated by fully immersed ageing tests with the standard CR for 168 hours at 100° C.

All the samples were tested for static and dynamic friction and wear. The apparatus used for carrying out such tests was the Optimol Instruments SRV (Schwingungen Reibung Verschliess) tester. The test consists of an upper ball specimen reciprocating under load on a flat disc lower specimen, with the grease lubricating the contact. It is an industry standard test and is especially relevant for the testing of greases for CV Joints.

A series of test methods using the SRV tester have been identified which are appropriate for the testing of greases for use in constant velocity joints. In this instance, the following conditions were used:

| Test | Load Newtons | Frequency Hz | Stroke mm | Temperature ° C. | Duration minutes |
|---|---|---|---|---|---|
| 1 | 200 | 40 | 1.5 | 80 | 60 |
| 2 | 200 | 40 | 3.0 | 80 | 60 |

The results in Tables 2 and 3 are the average of four test runs, two runs under each of the above conditions.

It will be seen from Tables 2 and 3 that the wear and friction figures and the rubber deterioration figures are much better for the greases in Table 3 which are those embodying the invention than they are in Table 2 which do not embody to the invention.

TABLE 2

| Grease Sample | 4 | 5 | 6 | 7 | 8 |
|---|---|---|---|---|---|
| Sample embodying the invention | No | No | No | No | No |
| Lithium soap | 5 | 5.5 | 5.5 | 5.5 | 5.5 |
| Naphthenic oil | (25) 21.85 | (25) 22.15 | (25) 22.15 | (25) 22.15 | (25) 21.85 |
| Paraffinic oil | (75) 65.55 | (55) 48.73 | (45) 39.87 | (45) 39.87 | (52) 45.45 |
| PAO | | (20) 17.72 | (20) 17.72 | (20) 17.72 | (15) 13.11 |
| Di-octyl sebacate (DOS) | | | | (10) | (8) |
| High Viscosity Polymer Ester | | | (10) 8.86 | 8.86 | 6.99 |
| Sulphur-free friction modifier | | 3 | 3 | 3 | 2 |
| MoDTP | 3 | | | | 1 |
| MoDTC | 1 | | | | |
| Primary/secondary ZDTP | 1 | 1 | 1 | 1 | |
| Secondary ZDTP | | | | | |
| Boron-containing anti-wear additive | | | | | 2 |
| Corrosion inhibitor 1 | | 1.3 | 1.3 | 1.3 | 1.3 |
| Corrosion inhibitor 2 | 2 | | | | |
| EP additive | 0.3 | 0.3 | 0.3 | 0.3 | 0.5 |
| Anti-oxidant | 0.3 | 0.3 | 0.3 | 0.3 | 0.3 |

TABLE 2-continued

| Grease Sample | 4 | 5 | 6 | 7 | 8 |
|---|---|---|---|---|---|
| Change in properties of rubber material after single sided ageing tests (120° C., 70 hours) | | | | | |
| Hardness on air side | −6 | 3 | 2 | −3 | −4 |
| Hardness on grease side | −20 | −9 | −8 | −16 | −17 |
| Glass transition temperature (° C.) | −44 | −43.3 | −44.8 | −49.6 | −47.6 |
| Change in properties of rubber material after fully immersed ageing tests (100° C., 168 hours) | | | | | |
| Tensile strength (%) | −5.4 | | | | |
| Elongation at failure (%) | −8.4 | | | | |
| Hardness (Shore A) | −15 | | | | |
| Volume (%) | 17.7 | | | | |
| Tribological performance on SRV tester | | | | | |
| Static friction | 0.073 | 0.066 | 0.098 | 0.082 | 0.074 |
| Dynamic friction | 0.052 | 0.056 | 0.084 | 0.076 | 0.061 |
| Wear ($mm^3/m$) | 640 | 660 | 500 | 940 | 260 |

TABLE 3

| Grease Sample | 9 | 10 | 11 | 12 | 13 |
|---|---|---|---|---|---|
| Sample embodying the invention | Yes | Yes | Yes | Yes | Yes |
| Li-soap | 6.0 | 6.5 | 6.5 | 6.5 | 6.5 |
| Naphthenic oil | (25) 21.95 | (25) 21.6 | (25) 21.73 | (25) 21.6 | (25) 21.6 |
| Paraffinic oil | (50) 43.95 | (50) 43.2 | (50) 43.45 | (50) 43.2 | (50) 43.2 |
| PAO | (20) 17.6 | (20) 17.28 | (20) 17.38 | (20) 17.28 | (20) 17.28 |
| DOS | (5)4.4 | (5)4.32 | (5)4.34 | (5)4.32 | (5)4.32 |
| Sulphur-free friction modifier | 2 | 2 | 1 | 2 | 1 |
| MoDTP | 1 | 1 | 2 | 1 | 2 |
| MoDTC | | | | | |
| Primary/secondary ZDTP | 1 | 2 | 1.5 | | 2 |
| Secondary ZDTP | | | | 2 | |
| Boron-containing anti-wear additive | | | | | |
| Corrosion inhibitor 1 | 1.3 | 1.3 | 1.3 | 1.3 | 1.3 |
| Corrosion inhibitor 2 | | | | | |
| EP additive | 0.5 | 0.5 | 0.5 | 0.5 | 0.5 |
| Anti-oxidant | 0.3 | 0.3 | 0.3 | 0.3 | 0.3 |
| Change in properties of rubber material after single sided ageing tests (120° C., 70 hours) | | | | | |
| Hardness on air side | 1 | +5 | | | |
| Hardness on grease side | −9 | −8 | | | |
| Glass transition temperature (C) | −46.6 | −46.0 | | | |
| Change in properties of rubber material after fully immersed ageing tests (100° C., 168 hours) | | | | | |
| Tensile strength (%) | | 1.3 | −3.2 | 2.0 | −5.1 |
| Elongation (%) | | 1.6 | −6.1 | −4.9 | −4.6 |
| Hardness (Shore A) | | −6 | −8 | −6 | −8 |
| Volume (%) | | 8.6 | 6.7 | 8.7 | 7.7 |
| Tribological performance on SRV tester | | | | | |
| Static friction | 0.053 | 0.054 | 0.060 | 0.056 | 0.055 |
| Dynamic friction | 0.040 | 0.042 | 0.044 | 0.042 | 0.044 |
| Wear ($mm^3/m$) | 380 | 0 | 0 | 0 | 330 |

Thus Sample 4 which does not embody the invention does not have the sulphur-free friction modifier nor the DOS and no PAO. Sample 5 has neither the DOS nor the MoDTP. Sample 6 does not have the MODTP or DOS but does contain a high viscosity polymer ester. Sample 7 has the esters and the sulphur-free friction modifier but does not have the MoDTP. Sample 8 has a Boron containing anti-wear additive which gives a low wear figure but relatively high co-efficient of friction. Samples 7 and 8 have more DOS than the optimum so that the hardness of the grease is decreased to an unacceptable extent.

The samples in Table 3 have the required base oil combination, the MoDTP, the ZDTP, the sulphur-free friction modifier and the other additives and give excellent wear and friction results and low figures for rubber deterioration. All the wear figures are below 500 $mm^3/m$ which is considered the upper limit for a satisfactory grease.

The other esters mentioned above may be substituted for the DOS.

FIG. 1 illustrates the comparative axial forces generated by a plunging tripod joint at various articulation angles. Grease Sample 4, which is not in accordance with the invention has considerably worse performance than grease Sample 10, which embodies the invention.

In summary, therefore, the grease according to the invention has very good compatibility with the CR used in CVJ boots while at the same time giving excellent friction and wear properties for the CVJ itself and low third order axial forces in plunging joints.

What is claimed is:

1. A lubricating grease comprising:

a. a base oil combination comprising 10% to 35% of one or more poly α-olefins, 3% to 15% of one more synthetic organic esters, 20% to 30% of one or more naphthenic oils, the remainder of the combination being one or more paraffinic oils, the percentages being by weight of the total base oil combination and the ratio of the weight of the ester(s) in the combination to the weight of the poly α-olefin(s) therein being not greater than 1:3;

b. between 2% and 15% by weight of the total grease of a lithium soap thickener;

c. between 1% and 5% by weight of the total grease of a molybdenum dithiophosphate of the following general formula:

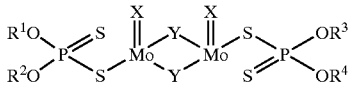

wherein X or Y represents S or O and each of $R^1$ to $R^4$ inclusive may be the same or different and each represents a straight chain or branched chain alkyl group having between 1 and 24 carbon atoms or an aryl group having between 6 and 30 carbon atoms;

d. between 1% and 5% by weight of the total grease of a zinc dialkyldithiophosphate of the following general formula:

$$(R^5O)(R^6O)SP—S—Zn—S—PS(OR^7)(OR^8)$$

wherein each of $R^5$ to $R^8$ inclusive may be the same or different and each represents a primary or secondary alkyl group having 1 to 24, preferably 3 to 8 carbon atoms;

e. between 1% and 5% by weight of the total grease of a sulphur-free friction modifier; and f. at least one normal grease additive such as an anti-oxidant, corrosion inhibitor, extreme pressure additive or tackiness agent.

2. A grease according to claim 1 wherein the ratio of the weight of the ester(s) to the weight of the poly α-olefin(s) is approximately 1:4.

3. A grease according to claim 1 or claim 2 wherein the percentage of sulphur-free friction modifier is between 1% and 2%.

4. A grease according to claim 1 or claim 2 wherein the percentage of molybdenum dithiophosphate is between 1% and 2%.

5. A grease according to claim 1 or claim 2 wherein the percentage of zinc dialkyldithiophosphate is between 1% and 2%.

6. A grease according to claim 1 or claim 2 wherein the synthetic organic ester is a reaction product of a di-carboxylic acid and aliphatic alcohols.

7. A grease according to claim 6 wherein the di-carboxylic acid is sebacic acid and the alcohols have primary, straight or branched carbon chains with 2 to 20 carbon atoms.

8. A grease according to claim 1 or claim 2 wherein the sulphur-free friction modifier is an organo molybdenum complex.

9. A grease according to claim 8 wherein the organo-molybdenum complex is a complex of an organo amide.

10. A grease according to claim 1 or claim 2 wherein the molybdenum dithiophosphate is sulphurised oxymolybdenum-2-ethylhexyl phosphorodithioate.

11. A grease according to claim 1 or claim 2 wherein the zinc dialkyldithiophosphate is a mixture of primary and secondary or wholly secondary alkyl dithiophosphates with carbon chains of between 3 and 14 atoms.

12. A grease according to claim 1 or claim 2 including between 0.5% and 3% by weight of the total grease of a calcium sulphonate salt as a corrosion inhibitor.

13. A grease according to claim 1 or claim 2 including a calcium salt of a substituted aromatic sulphonate as a corrosion inhibitor.

14. A grease according to claim 1 or claim 2 including one or more metal-free sulphur and phosphorous containing additive(s) as extreme pressure additive(s) in an amount of between 0.1% and 3% by weight of the total grease, such additive containing between 15% to 35% by weight of sulphur and between 0.5% and 3% by weight of phosphorous.

15. A grease according to claim 1 or claim 2 including an aromatic amine as an anti-oxidant.

16. A grease according to claim 15 wherein the amine is present in an amount of between 0.1% and 2% by weight of the total constituents of the grease and is either a phenyl alpha-naphthylamine or di-phenylamine or derivatives thereof.

17. A grease according to claim 15 wherein the amine is present in an amount of between 0.1% and 2% by weight of the total constituents of the grease and is a di-phenylamine or derivative thereof.

* * * * *